US008967981B2

(12) United States Patent
Durand et al.

(10) Patent No.: US 8,967,981 B2
(45) Date of Patent: Mar. 3, 2015

(54) MECHANICAL COMBUSTION ENGINE COOLANT PUMP

(75) Inventors: Jean-Michel Durand, Metz (FR); Pierre Reininger, Basse-Ham (FR); Laurent Finidori, Bertrange (FR)

(73) Assignee: Pierburg Pump Technology GmbH, Neuss (DE)

( * ) Notice: Subject to any disclaimer, the term of this patent is extended or adjusted under 35 U.S.C. 154(b) by 293 days.

(21) Appl. No.: 13/521,058

(22) PCT Filed: Dec. 15, 2010

(86) PCT No.: PCT/EP2010/069814

§ 371 (c)(1), (2), (4) Date: Oct. 9, 2012

(87) PCT Pub. No.: WO2011/083011

PCT Pub. Date: Jul. 14, 2011

(65) Prior Publication Data

US 2013/0019821 A1 Jan. 24, 2013

(30) Foreign Application Priority Data

Jan. 11, 2010 (EP) ..... 10150433

(51) Int. Cl.

*F04D 29/049* (2006.01)
*F01P 5/12* (2006.01)
*F04D 13/02* (2006.01)

(52) U.S. Cl.

CPC ..... *F01P 5/12* (2013.01); *F04D 29/049* (2013.01); *F04D 13/026* (2013.01); *F04D 13/027* (2013.01)

USPC ..... 417/223; 417/319; 417/364

(58) Field of Classification Search

CPC ... F04D 29/046; F04D 13/026; F04D 13/027; F04D 29/628; F04D 13/02; F04D 13/022; F04D 13/021; F04D 29/049

USPC ..... 417/423.6, 223, 319, 364, 423.12

See application file for complete search history.

(56) References Cited

U.S. PATENT DOCUMENTS

| | | | | |
|---|---|---|---|---|
| 7,144,225 | B2 * | 12/2006 | Boffelli et al. | 417/223 |
| 7,828,529 | B2 * | 11/2010 | Baumgartner et al. | 417/223 |
| 2002/0176773 | A1 | 11/2002 | Ozawa et al. | |

(Continued)

FOREIGN PATENT DOCUMENTS

| | | | |
|---|---|---|---|
| DE | 100 13 252 | A1 | 10/2001 |
| DE | 100 18 721 | A1 | 10/2001 |
| DE | 10 2006 021446 | A1 | 11/2007 |
| DE | 10 2008 013534 | A1 | 9/2009 |
| JP | 61-79899 | A | 4/1986 |

*Primary Examiner* — Bryan Lettman
(74) *Attorney, Agent, or Firm* — Norman B. Thot

(57) ABSTRACT

A mechanical combustion engine coolant pump for pumping a coolant for an internal combustion engine includes a stationary cylindrical support body. A rotatable driving wheel is supported by a driving wheel roller bearing at the stationary cylindrical support body. The rotatable driving wheel is configured to be driven by the internal combustion engine. A pump wheel is arranged at a rotatable rotor shaft. The pump wheel is supported by a shaft roller bearing at the stationary cylindrical supporting body. A switchable friction clutch is configured to couple the rotatable driving wheel with the pump wheel. The stationary cylindrical support body integrally comprises an inner ring of the driving wheel roller bearing. The stationary cylindrical support body integrally comprises an outer ring of the shaft roller bearing.

5 Claims, 1 Drawing Sheet

(56) References Cited

U.S. PATENT DOCUMENTS

2005/0178635 A1* 8/2005 Schultheiss et al. ..... 192/57
2005/0196297 A1 9/2005 Baumgartner et al.
2007/0110594 A1* 5/2007 Baumgartner et al. ..... 417/319
2012/0097496 A1* 4/2012 Greene ..... 192/69.5

* cited by examiner

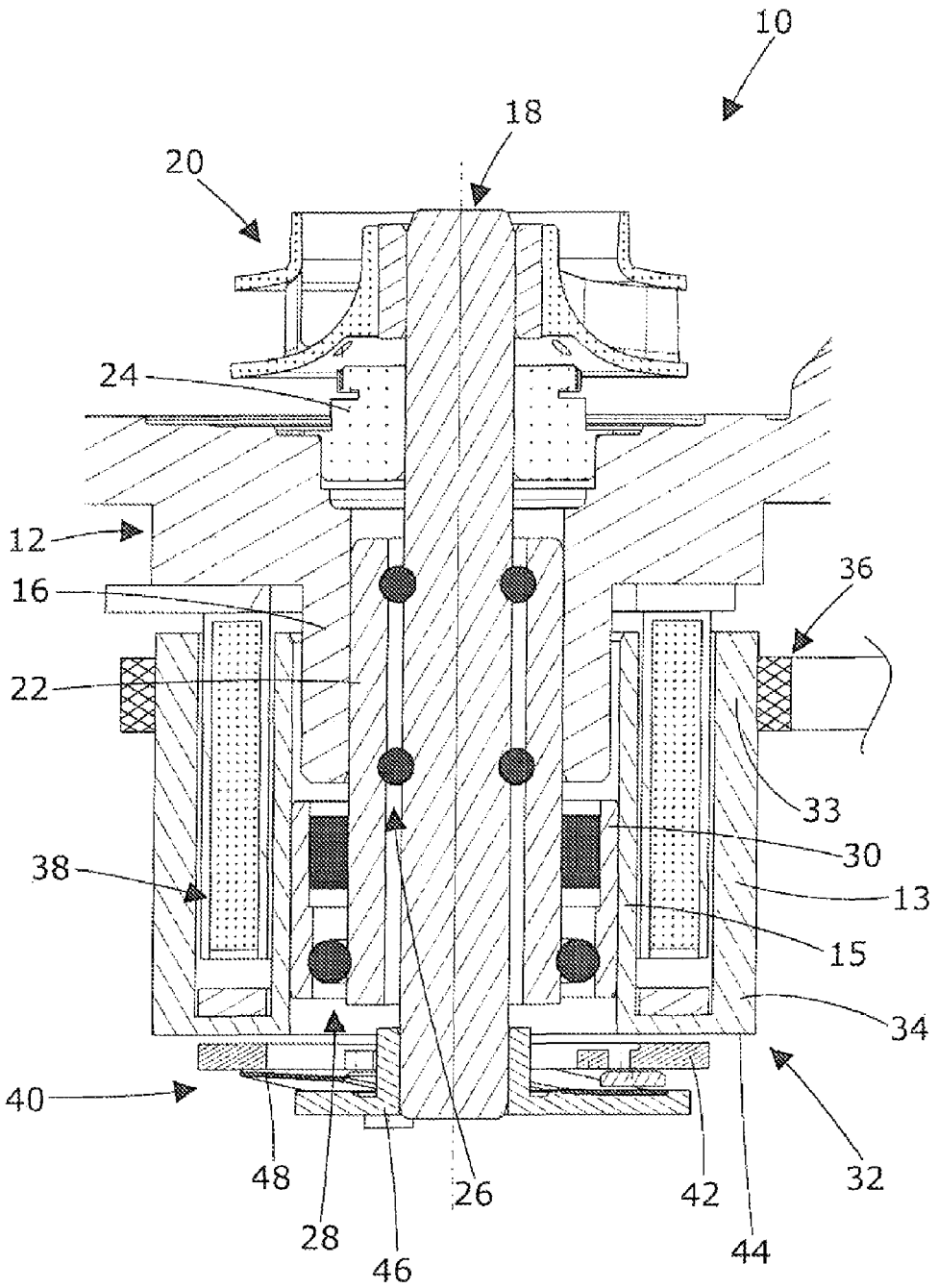
10
18
20
24
12
16
36
22
33
30
38
13
15
34
40
32
48
26
42
28
46
44

MECHANICAL COMBUSTION ENGINE COOLANT PUMP

CROSS REFERENCE TO PRIOR APPLICATIONS

This application is a U.S. National Phase application under 35 U.S.C. §371 of International Application No. PCT/EP2010/069814, filed on Dec. 15, 2010 and which claims benefit to European Patent Application No. 10150433.0, filed on Jan. 11, 2010. The International Application was published in English on Jul. 14, 2011 as WO 2011/083011 A1 under PCT Article 21(2).

FIELD

The present invention relates to a mechanical combustion engine coolant pump comprising a switchable friction clutch for pumping a coolant to an internal combustion engine.

BACKGROUND

A mechanical coolant pump is a coolant pump which is driven by a combustion engine, for example, by using a driving belt driving a driving wheel of the pump. As long as the combustion engine is cold, only a minimum or even no coolant flow is needed. witchable mechanical coolant pumps are therefore used which are provided with a friction clutch for coupling or decoupling the driving wheel with the shaft holding the pump wheel which is pumping the coolant.

The switchable coolant pump comprises a first roller bearing supporting the driving wheel at a stationary cylindrical supporting body and comprises a second rotor bearing supporting the rotatable shaft of the pump wheel. In practice, ready-made roller bearings are used which are press-fit onto the respective parts of the coolant pump. The press fitting process requires a highly accurate production of the corresponding cylindrical parts the coolant pump, i.e., of the inner and outer cylindrical surfaces of the stationary cylindrical supporting body, the outer surface of the rotating shaft and the inner surface of the driving wheel. The press fitting process is also a sophisticated process which causes a high assembly effort.

Even if the two roller bearings are not arranged radially in line, but are arranged axially in line, the outer diameter of the driving wheel is, in practice, higher than 9-10 centimeters.

For combustion engines with a relatively low displacement compact, coolant pumps with a relatively low outer diameter of the driving wheel are needed.

SUMMARY

An aspect of the present invention is to provide a simple and compact switchable mechanical coolant pump.

In an embodiment, the present invention provides a mechanical combustion engine coolant pump for pumping a coolant for an internal combustion engine which includes a stationary cylindrical support body. A rotatable driving wheel is supported by a driving wheel roller bearing at the stationary cylindrical support body. The rotatable driving wheel is configured to be driven by the internal combustion engine. A pump wheel is arranged at a rotatable rotor shaft. The pump wheel is supported by a shaft roller bearing at the stationary cylindrical supporting body. A switchable friction clutch is configured to couple the rotatable driving wheel with the pump wheel. The stationary cylindrical support body integrally comprises an inner ring of the driving wheel roller bearing. The stationary cylindrical support body integrally comprises an outer ring of the shaft roller bearing.

BRIEF DESCRIPTION OF THE DRAWINGS

The present invention is described in greater detail below on the basis of embodiments and of the drawings in which:

FIG. 1 shows a longitudinal cross section of a combustion engine coolant pump with a mechanical friction clutch actuated by an electromagnet.

DETAILED DESCRIPTION

The mechanical switchable coolant pump for pumping a coolant for an internal combustion engine is provided with a stationary cylindrical supporting body which is mounted to a pump frame body. The cylindrical supporting body integrally comprises the inner ring of the driving wheel roller bearing and integrally comprises the outer ring of the rotor shaft roller bearing. The cylindrical supporting body, the inner driving wheel roller bearing ring, and the outer shaft rotor bearing ring are realized in one single piece and are not mounted together. No roller bearings with separate inner and outer rings are used.

Since at least the inner ring of the driving wheel roller bearing and the outer ring of the shaft bearing are not separate, but are integrated parts of the cylindrical supporting body, said two rings don't need to be press-fit anymore to other parts. The mounting procedure is therefore simplified. Since at least two separate bearing rings fall away, the outer diameter of the driving wheel can be reduced significantly so that the pump rotor is driving with a higher rotational speed, and a more compact and weight-reduced coolant pump can be realized. This fulfills the needs of the engine designers.

At least two press-fit connections fall away so that the manufacturing of the respective parts can be less precise and, as a consequence, less cost-intensive.

In an embodiment of the present invention, the rotatable shaft can, for example, integrally comprise the inner ring of the shaft roller bearing so that the shaft roller bearing does not comprise any separate roller bearing ring. As a consequence, the outer diameter of the driving wheel is even more reduced and the pump is more compact and weight-reduced.

In an embodiment of the present invention, the cylindrical supporting body can, for example, be a separate part and be press-fit into a cylindrical portion of a pump frame body. The outer cylindrical surface of the supporting body can, for example, be press-fit into the inner cylindrical surface of the pump housing body. This configuration allows the separate pre-fabrication of the arrangement composed of the rotor shaft, the cylindrical supporting body and the two roller bearings. This pre-fabricated arrangement is then assembled with the pump frame body, the pump wheel, the driving wheel, the axially movable clutch friction ring and the clutch electromagnet.

In an embodiment the present invention, the outer ring of the driving wheel roller bearing can, for example, be formed by a separate bearing ring which is press-fit into a body of the driving wheel.

In an embodiment of the present invention, the shaft roller bearing can, for example, be axially overlapped by a cylindrical portion of the pump frame body. As a consequence, the complete axial length of the shaft roller bearing is supported by the pump frame body so that the rotor shaft, the pump wheel at one axial and a mechanical clutch at the other axial end of the rotor shaft are supported as stiff and stable as possible.

In an embodiment of the present invention, the driving wheel roller bearing can, for example, be arranged completely axially distal of the cylindrical portion of the pump frame body. The driving wheel roller bearing can, for example, be arranged axially adjacent to the cylindrical pump frame body portion. This arrangement reduces the radial extension of the driving wheel.

In an embodiment of the present invention, the driving belt section of the driving wheel can, for example, axially overlap the shaft roller bearing so that the driving belt is arranged axially close to the pump frame body and to the combustion engine.

In an embodiment of the present invention, the friction clutch can, for example, be activated by an electromagnet which is fixed to the pump frame body. The driving wheel body can, for example, be preferably U-shaped in cross-section and comprises a ring-like cavity which is open at the axial proximal end thereof. The electromagnet can be arranged inside of the cavity of the driving wheel. The distal end of the driving wheel is provided with a friction ring which cooperates with an axially movable friction ring fixed to the rotor shaft. The two friction rings define the switchable friction clutch for coupling the driving wheel with the pump wheel. The electromagnet causes an axial push- or pull-force to the movable friction ring.

FIG. 1 shows a longitudinal section of a switchable coolant pump 10 which is driven by an internal combustion engine (not shown) and is pumping a liquid coolant through the coolant channels of the combustion engine block (not shown).

The coolant pump 10 is provided with a driving wheel 32 comprising a diving belt section 33 for a driving belt 36, with a pump wheel 20 supported by a rotating axial rotor shaft 18 and with a switchable mechanical friction clutch 40 which is switched by an electromagnet 38. The friction clutch 40 in the engaged state connects the driving wheel 32 with the pump wheel 20 via the rotor shaft 18.

The rotatable driving wheel body 34 is U-shaped in cross section and consists of a ferromagnetic material. The axial ring-like opening of the driving wheel body 34 is orientated axially proximal towards the pump wheel 20. The proximal end of the radially outside leg 13 of the U-shaped driving wheel body 34 defines the cylindrical driving belt section 33. The radially inside leg 15 is a cylinder as well and is supported by a driving wheel roller bearing 28 which is supported at a stationary cylindrical support body 22.

The support body 22 is press-fit into a cylindrical pump frame body portion 16 of a pump frame body 12 which is mountable to an engine block of the internal combustion engine. The inner bearing ring of the driving wheel roller bearing 28 is an integral part of the outside of the support body 22 and the outer roller bearing ring is a separate outer bearing ring 30. The separate outer bearing ring 30 of the driving wheel roller bearing 28 is press-fit into the cylindrical radially inside leg 15 of the driving wheel body 34.

The rotor shaft 18 is supported by a shaft roller bearing 26 at the cylindrical support body 22. The inner ring of this roller shaft bearing 26 is an integral part of the rotor shaft 18 and the outer bearing ring is an integral part of the cylindrical support body 22.

The rotating rotor shaft 18 is sealed against the pump frame body 12 by a shaft sealing 24.

The driving wheel roller bearing 28 is completely arranged axially distal of the cylindrical portion 16 of the pump frame body 12. The driving wheel roller bearing 28 is arranged axially adjacent to the cylindrical pump frame body portion 16. The driving belt section 33 of the driving wheel body 34 is axially overlapping and radially in line with the shaft roller bearing 26 so that the driving belt 36 is arranged axially close to the pump frame body 12 and to the combustion engine.

The friction clutch 40 is provided with a shaft-sided friction ring 42 supported by the rotor shaft 18 and with an opposite friction ring 44 formed by the axial outside (distal) surface of a radial ring connecting the two legs 13, 15 of the driving wheel 32. The shaft sided friction ring 42 is supported by a hub body 46 which is fixed to the rotor shaft 18 and by a preload disk spring 48 fixed to the hub body 46 and holding the shaft-sided friction ring 42. The preload disk spring 48 axially preloads or biases the opposite friction ring 44, and therefore the friction clutch 40, into a disengaged state.

Inside the ring-like cavity and enclosed by the U-shaped driving wheel 32, a stationary electromagnet 38 is arranged and is fixed to the pump frame body 12. The electromagnet 38 consists of a ring-like exciting coil which generates a toroidal electromagnetic field when the electromagnet 38 is energized with direct current (DC). When the electromagnet 38 is energized, the clutch 40 is engaged.

The rolling elements of the roller bearings 26, 28 can be balls, cylinders or needles.

The present invention is not limited to embodiments described herein; reference should be had to the appended claims.

What is claimed is:

1. A mechanical combustion engine coolant pump for pumping a coolant for an internal combustion engine, the mechanical combustion engine coolant pump comprising:

a stationary cylindrical support body;

a rotatable driving wheel supported by a driving wheel roller bearing at the stationary cylindrical support body, the rotatable driving wheel being configured to be driven by the internal combustion engine;

a pump wheel arranged at a rotatable rotor shaft, the pump wheel being supported by a shaft roller bearing at the stationary cylindrical supporting body;

a switchable friction clutch configured to couple the rotatable driving wheel with the pump wheel; and a pump frame body comprising a cylindrical portion, wherein, the stationary cylindrical support body is integrally formed as a single piece with each of an inner ring of the driving wheel roller bearing and an outer ring of the shaft roller bearing, the stationary cylindrical support body is press-fit into the cylindrical portion of the pump frame body, the shaft roller bearing is axially overlapped by the cylindrical portion of the pump frame body, and the driving wheel roller bearing is arranged so as to be axially distal of the cylindrical portion of the pump frame body.

2. The mechanical combustion engine coolant pump as recited in claim 1, wherein the shaft roller bearing further comprises an inner ring, and wherein the rotatable rotor shaft integrally comprises the inner ring of the shaft roller bearing.

3. The mechanical combustion engine coolant pump as recited in claim 2, further comprising an electromagnet fixed to the pump frame body, and a switchable friction clutch, wherein the switchable friction clutch is configured to be actuated by the electromagnet.

4. The mechanical combustion engine coolant pump as recited in claim 1, further comprising a separate bearing ring and a driving wheel body, wherein the driving wheel roller bearing comprises an outer ring formed by the separate bearing ring which is press-fit into the driving wheel body.

5. The mechanical combustion engine coolant pump as recited in claim 1, wherein the rotatable driving wheel comprises a driving belt section which axially overlaps the shaft roller bearing.

* * * * *